US005555945A

United States Patent [19]

Schultz et al.

[11] Patent Number: 5,555,945

[45] Date of Patent: Sep. 17, 1996

[54] EARLY EVALUATION BY FALL-OFF TESTING

[75] Inventors: Roger L. Schultz, Stillwater, Okla.; H. Kent Beck, Copper Canyon; Paul D. Ringgenberg, Carrollton, both of Tex.; Ronald L. Hinkie, Marlow, Okla.

[73] Assignee: Halliburton Company, Dallas, Tex.

[21] Appl. No.: 290,653

[22] Filed: Aug. 15, 1994

[51] Int. Cl.[6] ..... E21B 49/00

[52] U.S. Cl. ..... 175/50; 175/233; 166/250.07

[58] Field of Search ..... 175/50, 233, 236, 175/218; 166/250, 264, 373, 384, 385, 386, 387, 250.07

[56] References Cited

U.S. PATENT DOCUMENTS

| | | | |
|---|---|---|---|
| 1,899,497 | 2/1933 | Doherty . | |
| 2,125,159 | 7/1938 | Hanes | 166/1 |
| 2,222,829 | 11/1940 | Humason et al. | 166/1 |
| 2,280,785 | 4/1942 | Boynton | 166/11 |
| 2,392,683 | 1/1946 | McWhorter | 255/1.4 |
| 2,497,185 | 2/1950 | Reistle, Jr. | 166/1 |
| 2,677,790 | 5/1954 | Arps | 224/1 |
| 2,702,474 | 2/1955 | Johnston | 73/152 |
| 2,751,016 | 6/1956 | Watzlavick | 166/187 |
| 2,819,038 | 1/1958 | Eckel | 175/233 X |
| 2,978,046 | 4/1961 | True | 175/233 |
| 3,103,811 | 9/1963 | Ayres et al. | 166/66 |
| 3,107,729 | 10/1963 | Barry et al. | 166/66 |
| 3,111,169 | 11/1963 | Hyde | 166/145 |
| 3,175,392 | 3/1965 | Tharalson et al. | 73/84 |
| 3,182,725 | 5/1965 | Moore | 166/65 |
| 3,279,249 | 10/1966 | Tocanne | 73/153 |
| 3,327,781 | 6/1967 | Nutter | 166/3 |
| 3,353,612 | 11/1967 | Bannister | 175/6 |
| 3,412,607 | 11/1968 | Jensen | 73/155 |
| 3,441,095 | 4/1969 | Youmans | 175/59 |
| 3,448,611 | 6/1969 | Lebourg | 73/151 |
| 3,459,264 | 8/1969 | Olson et al. | 166/250 |
| 3,500,911 | 3/1970 | Farley et al. | 166/250 |
| 3,577,781 | 5/1971 | Lebourg et al. | 73/152 |
| 3,577,783 | 5/1971 | Whitten et al. | 73/152 |
| 3,611,799 | 10/1971 | Davis | 73/155 |
| 3,780,575 | 12/1973 | Urbanosky | 73/152 |
| 3,850,240 | 11/1974 | Conover | 166/162 |
| 3,864,970 | 2/1975 | Bell | 73/155 |
| 3,876,003 | 4/1975 | Kisling, III | 166/250 |
| 3,895,520 | 7/1975 | Fertl | 73/152 |
| 3,969,937 | 7/1976 | Barrington et al. | 73/151 |
| 4,031,957 | 6/1977 | Sanford | 166/264 |
| 4,043,407 | 8/1977 | Wilkins | 175/50 |
| 4,142,594 | 3/1976 | Thompson et al. | 175/233 X |
| 4,230,180 | 10/1980 | Patton et al. | 166/185 |
| 4,246,964 | 1/1981 | Brandell | 166/106 |
| 4,287,946 | 9/1981 | Brieger | 166/100 |
| 4,313,495 | 2/1982 | Brandell | 166/53 |
| 4,317,490 | 3/1982 | Milberger et al. | 175/233 X |
| 4,339,948 | 7/1982 | Hallmark | 73/155 |
| 4,370,886 | 2/1983 | Smith, Jr. et al. | 73/153 |
| 4,392,376 | 7/1983 | Lagus et al. | 73/155 |
| 4,535,843 | 8/1985 | Jageler | 166/250 |
| 4,566,535 | 1/1986 | Sanford | 166/113 |

(List continued on next page.)

*Primary Examiner*—William P. Neuder
*Attorney, Agent, or Firm*—William M. Imwalle; C. Clark Dougherty, Jr.

[57] ABSTRACT

Early evaluation testing of a subsurface formation is provided by monitoring pressure fall-off in the formation. This is accomplished by providing a column of fluid in the well having an overbalanced, hydrostatic pressure at the subsurface formation greater than a natural formation pressure of the subsurface formation. A testing string is run into the well, and the testing string includes a packer, a pressure monitor and a closure tool arranged to close a bore of the testing string. The formation is shut in by setting the packer and closing the bore of the testing string with the closure tool and thereby initially trapping the overbalanced hydrostatic pressure of the column of fluid in the well below the packer. Then the pressure in the well below the packer is monitored as it falls off toward the natural formation pressure. This data can be extrapolated to estimate the natural formation pressure based upon a relatively short actual test interval on the order of ten to fifteen minutes.

22 Claims, 6 Drawing Sheets

U.S. PATENT DOCUMENTS

| | | | |
|---|---|---|---|
| 4,573,532 | 3/1986 | Blake | 166/264 |
| 4,580,632 | 4/1986 | Reardon | 166/250 |
| 4,583,595 | 4/1986 | Czernichow et al. | 166/264 |
| 4,635,717 | 1/1987 | Jageler | 166/250 |
| 4,729,430 | 3/1988 | White | 166/106 |
| 4,745,802 | 5/1988 | Purfurst | 73/155 |
| 4,838,349 | 6/1989 | Berzin | 166/187 |
| 4,860,580 | 8/1989 | DuRocher | 73/155 |
| 4,866,607 | 9/1989 | Anderson et al. | 264/422 |
| 4,898,236 | 2/1990 | Sask | 166/65.1 |
| 4,936,139 | 6/1990 | Zimmerman et al. | 73/155 |
| 4,955,438 | 9/1990 | Juergens et al. | 175/40 |
| 4,962,815 | 10/1990 | Schultz et al. | 166/387 |
| 5,058,674 | 10/1991 | Schultz et al. | 166/264 |
| 5,095,745 | 3/1992 | Desbrandes | 73/152 |
| 5,105,881 | 4/1992 | Thoms et al. | 166/250 |
| 5,184,508 | 2/1993 | Desbrandes | 73/152 |

EARLY EVALUATION BY FALL-OFF TESTING

BACKGROUND OF THE INVENTION

1. Field of the Invention

The present invention relates generally to the testing of oil and gas wells to determine the natural formation pressure of the subsurface formation and the producing characteristics of the subsurface formation, and more particularly, but not by way of limitation, to such techniques which are especially applicable to early evaluation testing of an open borehole soon after the borehole is drilled into the subsurface formation of interest.

2. Description of the Prior Art

During the drilling and completion of oil and gas wells, it is often necessary to test or evaluate the production capabilities of the well. This is typically done by isolating a subsurface formation which is to be tested and subsequently flowing a sample of well fluid either into a sample chamber or up through a tubing string to the surface. Various data such as pressure and temperature of the produced well fluids may be monitored downhole to evaluate the long-term production characteristics of the formation.

One very commonly used well testing procedure is to first cement a casing in the borehole and then to perforate the casing adjacent zones of interest. Subsequently the well is flow tested through the perforations. Such flow tests are commonly performed with a drill stem test string which is a string of tubing located within the casing. The drill stem test string carries packers, tester valves, circulating valves and the like to control the flow of fluids through the drill stem test string.

Typical tests conducted with a drill stem test string are known as draw-down and build-up tests. For the "draw-down" portion of the test, the tester valve is opened and the well is allowed to flow up through the drill string until the formation pressure is drawn down to a minimum level. For the "build-up" portion of the test, the tester valve is closed and the formation pressure is allowed to build up below the tester valve to a maximum pressure. Such draw-down and build-up tests may take many days to complete.

There is a need for quick, reliable testing procedures which can be conducted at an early stage in the drilling of the well, preferably before casing has been set. This is desirable for a number of reasons. First, if the well is proven not to be a commercially successful well, then the cost of casing the well can be avoided or minimized. Second, it is known that damage begins occurring to the subsurface formation as soon as it is intersected by the drilled borehole, and thus it is desirable to conduct testing at as early a stage as possible.

On the other hand, there are a number of difficulties encountered in the testing of open, uncased boreholes. This is particularly true for subsea wells. Due to safety considerations it is often considered undesirable to flow test an open hole subsea well through a drill stem test string.

Also, it is not convenient to do conventional draw-down, build-up testing in an open hole situation because the pipe is full of drilling mud which would have to be circulated out. It is preferable to conduct a test with a safe dead well which is completely kept under control due to the presence of the column of heavy drilling mud.

Also, at this early stage of drilling the well, there is a need for a test which can be conducted very rapidly so that repeated tests can be conducted as the well is drilled to quickly evaluate the various subsurface formations which may be intersected as the well is drilled. Conventional draw-down and build-up tests can take several days to complete, and they substantially interrupt the drilling process.

SUMMARY OF THE INVENTION

The present invention provides improved methods for the rapid and safe evaluation of a well. These methods are particularly well adapted for use in the early evaluation of wells during the drilling procedure when the wells are still in an uncased condition.

The methods of the present invention center upon the use of a pressure fall-off test wherein in an overbalanced hydrostatic pressure is trapped adjacent a zone of interest in a subsurface formation and then the pressure is monitored as that overbalanced pressure bleeds off into the subsurface zone.

Preferably such a method includes a first step of providing a column of fluid in the well, the column of fluid having an overbalanced hydrostatic pressure at the subsurface zone which is to be tested greater than a natural formation pressure of the subsurface zone.

A testing string is run into the well. The testing string may be the drill string which has just drilled the borehole, or it may be a separate string which is run after the borehole has been drilled. The testing string preferably includes at least a packer, a pressure monitor, and a closure tool arranged to close a bore of the testing string.

The subsurface zone is shut in by setting the packer and closing the bore of the testing string with the closure tool thereby initially trapping the overbalanced hydrostatic pressure of said column of fluid in the well below the packer.

Then, the pressure in the well below the packer is closely monitored as the pressure falls off from the trapped, overbalanced, hydrostatic pressure toward the natural formation pressure of the subsurface zone.

Such a test may be conducted for a relatively short period of time, on the order of ten to fifteen minutes, and will provide sufficient data with sufficient precision that the data can then be extrapolated to estimate the natural formation pressure of the subsurface zone.

This test can be repeated any number of times to verify the data.

Additionally, such a pressure fall-off test can be conducted at various depths as the well is advanced downwardly. A comparison of the pressure fall-off data for the various tests provides an indication as to whether new subsurface geological formations have been intersected.

At desired times depending upon the observed fall-off test results, fluid samples can be taken from the well.

Other modifications of these techniques can provide additional data.

One modification is to pump down the well pressure to below the natural formation pressure and then monitor pressure build-up adjacent the formation.

Another modification is to inject high pressure fluids into the well at greater than the hydrostatic pressure present in the well thus providing an injection fall-off test.

Numerous objects, features and advantages of the present invention will be readily apparent to those skilled in the art upon a reading of the following disclosure when taken in conjunction with the accompanying drawings.

BRIEF DESCRIPTION OF THE DRAWINGS

FIGS. 8A–8C comprise a sequential series of drawings somewhat similar to those of FIGS. 1A–1E illustrating an alternative method of the present invention wherein the fall-off pressure tests are conducted with a testing string which does not include a drill bit. The borehole is drilled by another string which is removed and then the testing string illustrated in FIGS. 8A–8C is run into place. This particular testing string is illustrated as including a surge receptacle and surge chamber for withdrawing a well fluid sample.

DETAILED DESCRIPTION OF THE PREFERRED EMBODIMENTS

Figure 1C:
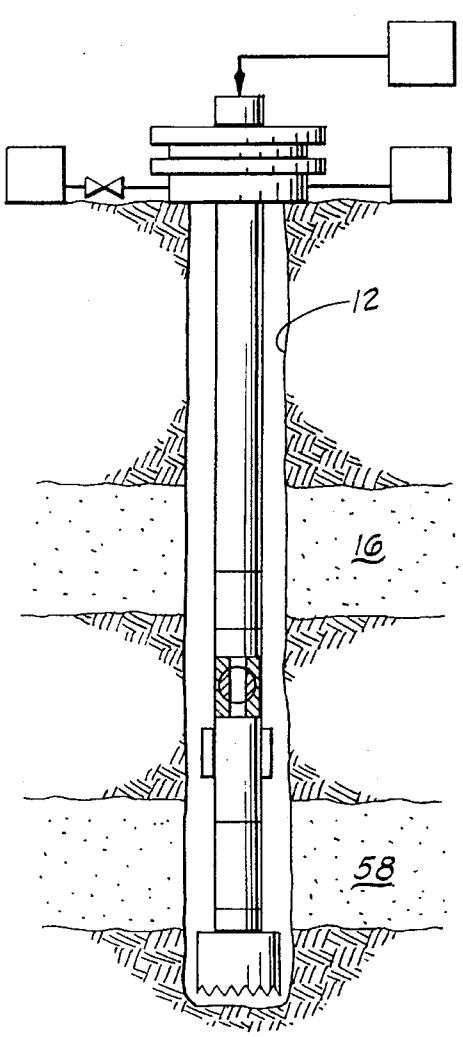
FIGS. 1A–1E provide a sequential series of illustrations in elevation, sectioned, schematic format showing the advancement of a well and the periodic pressure fall-off testing of the well in accordance with the present invention.

Referring now to the drawings, and particularly to FIGS. 1A–1E, the methods and apparatus of the present invention are schematically illustrated.

A well 10 is defined by a borehole 12 extending downward from the earth's surface 14 and intersecting a first subsurface zone or formation of interest 16.

A drill stem testing string 18 is shown in place within the borehole 12. The testing string 18 includes a tubing string 20, a tester valve 22, a packer means 24, a pressure monitoring means 26, and a drill bit 28.

The tester valve 22 may be generally referred to as a tubing string closure means 22 for closing the bore of tubing string 20 and thereby shutting in the subsurface formation 16.

The packer means 24 carries an expandable packing element 30 for sealing a well annulus 32 between the testing string 18 and well bore 12. The packing element 30 may be either a compression type packing element or an inflatable type packing element. When the packing element 30 is expanded to a set position as shown in FIG. 1B, it closes in the well annulus 32 therebelow adjacent the subsurface formation 16. That subsurface formation 16 communicates with the interior of the testing string 18 through ports (not shown) present in the drill bit 28.

The pressure monitoring means 26 will contain instrumentation for monitoring and recording various well fluid parameters such as pressure and temperature. It may for example be constructed in a fashion similar to that of Anderson et al., U.S. Pat. No. 4,866,607, assigned to the assignee of the present invention. The Anderson et al. device monitors pressure and temperature and stores it in an on-board recorder. That data can then be recovered when the testing string 18 is removed from the well.

Alternatively, the pressure monitoring means 26 may be a Halliburton RT-91 system which permits periodic retrieval of data from the well through a wireline with a wet connect coupling which is lowered into engagement with the monitoring device 26. This system is constructed in a fashion similar to that shown in U.S. Pat. No. 5,236,048 to Skinner et al., assigned to the assignee of the present invention.

Another alternative monitoring system 26 can provide constant remote communication with a surface command station 34 through mud pulse telemetry or other remote communication systems, as is further described below.

Regardless of which form of pressure monitoring system 26 is utilized, it is necessary that the system be capable of monitoring pressure fall-off data with sufficient precision to allow extrapolation of that data to estimate natural formation pressures as is further described below with regard to FIGS. 2–4.

Figure 1B:
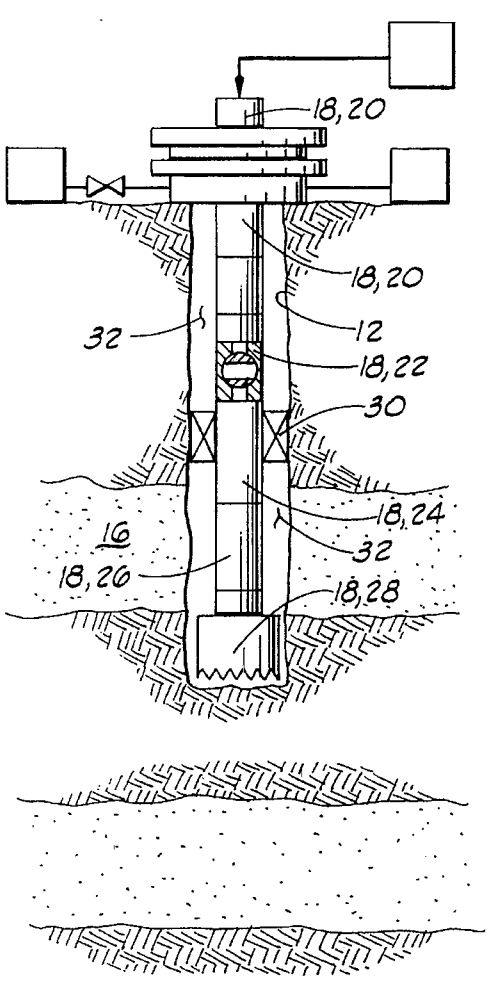
Figure 1A:
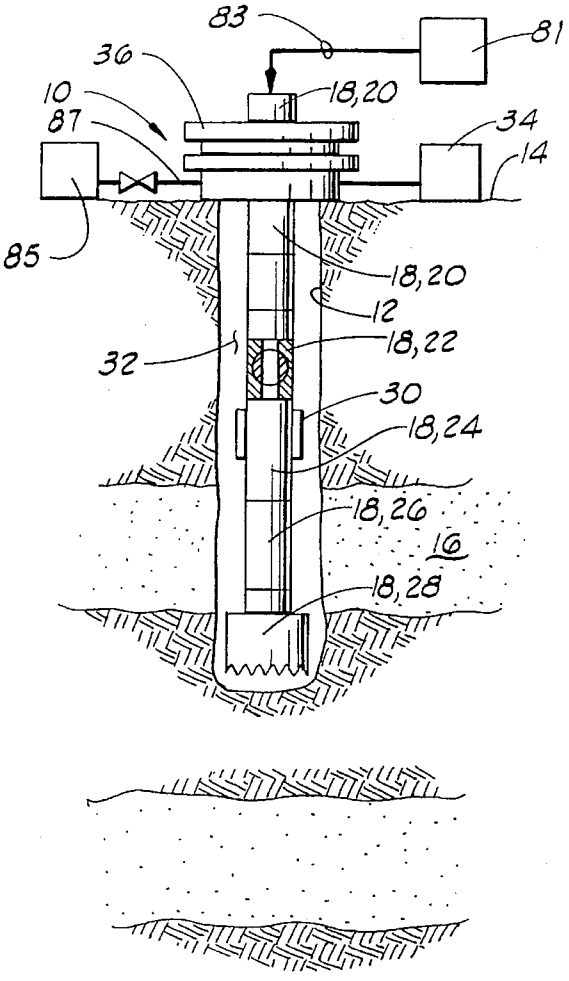

The tester valve 22 may, for example, be a ball-type tester valve 22 as illustrated in FIG. 1A. Other alternative types of closure devices may be utilized for opening and closing the bore of testing string 18. One such alternative device is illustrated and described below with regard to FIG. 7.

The packer means 24 and tubing string closure means 22 may be operably associated so that the tubing string closure means 22 automatically closes when the packer means 24 is set to seal the uncased borehole 12. For example, the ball-type tester valve 22 may be a weight set tester valve and have associated therewith an inflation valve communicating the tubing string bore above the tester valve with the inflatable packer element 30 when the closure valve 22 moves from its open to its closed position. Thus upon setting down weight to close the tester valve 22, the inflation valve communicated with the packing element 30 is opened and then tubing string pressure within the tubing string 20 may be increased to inflate the inflatable packer element 30.

Other arrangements can include a remotely controlled packer and tester valve which are operated in response to remote command signals such as described and illustrated below with regard to FIGS. 6 and 7.

Also, the tester valve 22 and packer 24 may both be weight operated so that when weight is set down upon the tubing string, a compressible, expansion-type packer element is set at the same time that the tester valve is moved to a closed position.

In FIG. 1A, the testing string 18 is shown extending through a conventional blow-out preventor stack 36 located at the earth's surface 14. The testing string 18 is suspended from a conventional rotary drilling rig (not shown) in a well-known manner.

FIG. 1A shows the drill stem testing string 18 in a drilling position wherein it has just drilled the borehole 12 down through the first subsurface formation 16. The packer 18 is in a retracted position and the ball-type tester valve 22 is in an open position so that drilling fluids may be circulated down through the drill stem test string 18 and up through the annulus 32 in a conventional manner during the drilling operations.

During this drilling operation, the well annulus 12 is typically filled with a drilling fluid commonly known as drilling mud, which is weighted with various additives and the like to provide an overbalanced hydrostatic pressure adjacent the subsurface formation 16. That overbalanced hydrostatic pressure is greater than the natural formation pressure of subsurface formation 16, so as to prevent the well from blowing out.

After the borehole 12 has intersected the first subsurface formation 16, if it is desired to test the subsurface formation 16 to estimate the natural formation pressure thereof, this can be accomplished by shutting in the subsurface formation 16 as illustrated in FIG. 1B. This is accomplished by setting the packer 24 to close the well annulus 32 and by closing the ball valve 22 to close the bore of test string 18. This initially traps adjacent the subsurface formation 16 the overbalanced hydrostatic pressure that was present due to the column of drilling fluid.

After the packer 24 is set and the tester valve 22 is closed, the fluids trapped in the well annulus 32 below packer 24 are no longer communicated with the standing column of fluid and thus the trapped pressure will slowly leak off into the surrounding subsurface formation 16, i.e., the bottom hole pressure will fall off.

Figure 2:
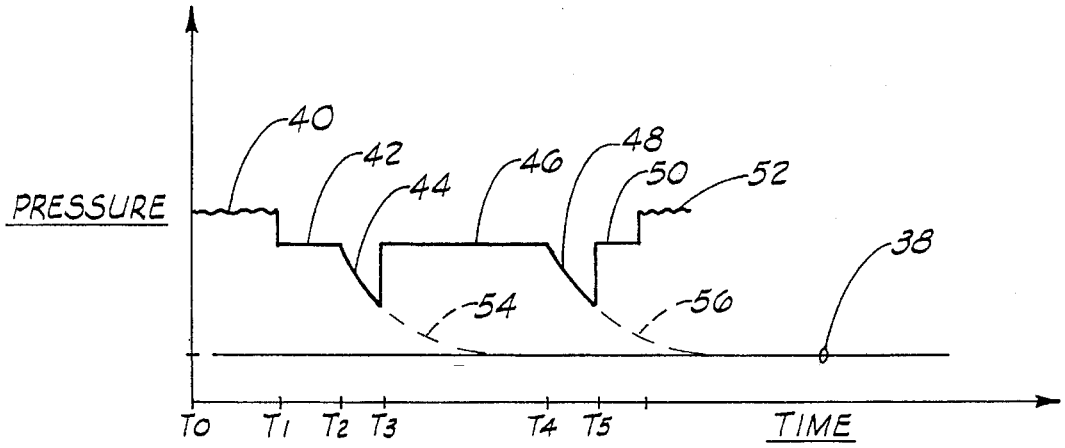
FIG. 2 is a pressure-versus-time plot showing repeated pressure fall-off tests.

FIG. 2 shows a pressure-versus-time curve which represents a series of two such pressure fall-off tests.

In FIG. 2, the horizontal line 38 represents the natural formation pressure of subsurface formation 16.

As the well bore 12 is being drilled, the pressure monitored by monitor 26 would be at a level indicated by the erratic line 40. The line 40 is erratic to represent the pressure surging which occurs due to the pumping of drilling fluid through the test string. When pumping stops at time $T_1$, the pressure will drop to a hydrostatic pressure level indicated by the horizontal line 42. The hydrostatic pressure 42 represents that which would be monitored in FIG. 1A after pumping stops but before the packer 24 is set and the tester valve 22 is closed at time $T_2$.

After the packer 24 is set and the tester valve 22 is closed as illustrated in FIG. 1B, the pressure in the well bore 12 adjacent subsurface formation 16 will begin to fall off as represented by the fall-off curve 44.

The packer 24 remains set and the tester valve 22 remains closed for an interval of time from $T_2$ to $T_3$ which may for example be on the order of ten to fifteen minutes. The time from $T_2$ to $T_3$ may be longer or shorter depending on the particular formation characteristics and how much data is needed.

At time $T_3$ the tester valve 22 is opened which again communicates the overbalanced hydrostatic well pressure with the subsurface formation 16 so that the pressure monitored by monitoring means 26 returns to the level 46. At time $T_4$ the tester valve 22 is again closed thus causing a second pressure fall-off curve 48 to be generated. At time $T_5$ the tester valve 22 is again opened thus allowing pressure to return to hydrostatic pressure level 50.

Then the packer 24 is unset and drilling resumes along with the circulation of drilling fluid and pressure returns to the pumping level 52. Also, the packer 24 could be unset each time tester valve 22 is opened, though it need not be.

In the instance of each of the fall-off curves 44 and 48, the tester valve 22 was maintained closed only for a time sufficient to generate enough fall-off data to allow the natural formation pressure 38 to be estimated by extrapolating the fall-off curves 44 and 48 to estimate the path they would follow as shown in dashed lines 54 and 56, respectively, if they had been allowed time to fall off completely to the natural formation pressure 38.

Figure 1E:
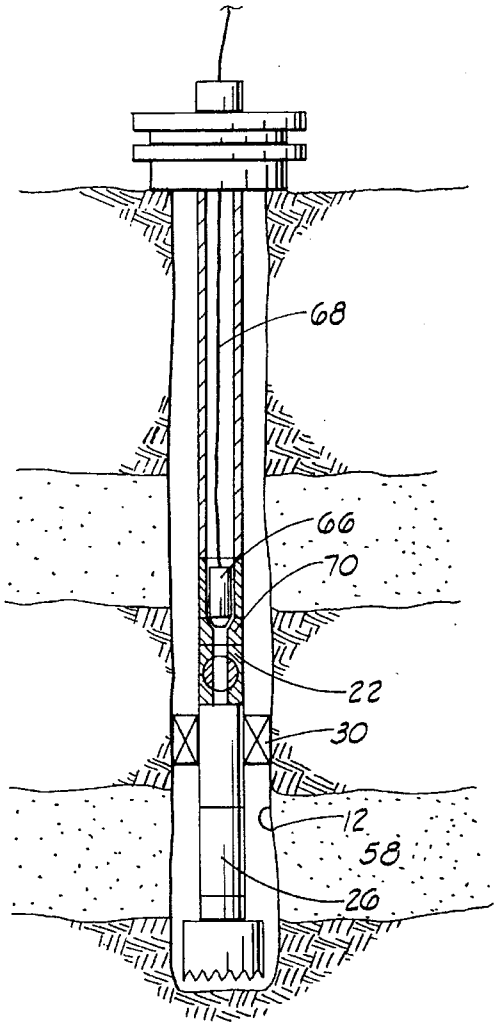
Figure 1D:
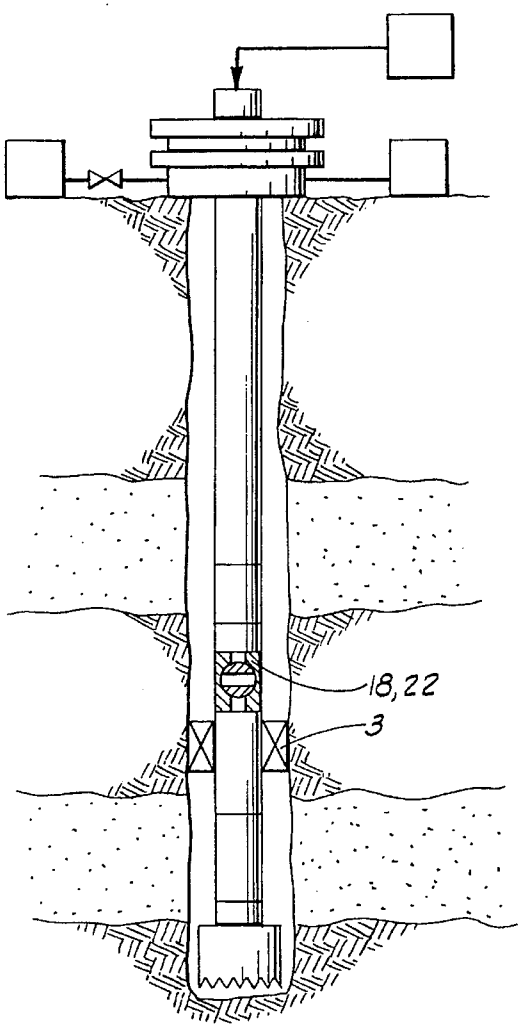

FIG. 1C illustrates the extension of the well bore 12 to intersect a second subsurface formation 58. This is accomplished by retracting packer 24, opening tester valve 22 and resuming drilling in a conventional manner. After the second subsurface formation 58 has been intersected, the packer 24 can be set and the tester valve 22 closed as illustrated in FIG. 1D to perform pressure fall-off tests on the second subsurface formation 58. The tests conducted on second subsurface formation 58 would be conducted in a manner like that described above with regard to FIG. 2.

Of course it will be realized that quite often the well operator will not know the exact nature of the subsurface geological formations which have been penetrated. Often the purpose of the testing is to determine what formations are present at various depths.

The pressure fall-off testing like that illustrated in FIG. 2 provides a significant opportunity for comparison of test data which provides valuable results in addition to any absolute quantitative data which may be obtained.

In a given geological formation, the pressure fall-off curves 44 and 48 will have a distinctive shape which is characteristic of the formation. Thus when subsequent tests are performed at different levels, such as for example the tests schematically illustrated in FIG. 1B and FIG. 1D, a comparison of the shape of the pressure fall-off curves provides an indication as to whether the two tests have been conducted in a common geological formation or whether they have been conducted in different geological formations.

This is significant in many respects. For one thing, so long as it is determined that no new geological formation has been intersected, it may be unnecessary to collect additional well fluid samples. If a well fluid sample is collected in connection with the first pressure fall-off test, and if a subsequent pressure fall-off test indicates that the borehole is still penetrating the same formation as previously tested, then there is no need to draw additional well fluid samples. On the other hand, if the comparative shapes of the pressure fall-off curves show that a new formation has been reached, then it may be desirable to take an additional well fluid sample.

In the embodiment shown in FIGS. 1A–1E, the pressure fall-off testing is conducted simply by interrupting drilling of the well. The testing is conducted without removing the drill string from the borehole.

It will be appreciated, however, that pressure fall-off testing like that described with regard to FIG. 2 above can be conducted with a testing string which does not include a drill bit if the borehole 12 has previously been formed. Such tests are illustrated and described below with regard to FIGS. 8A–8C.

Any number of occurrences during the drilling operation may provide an indication to the operator that it is desirable to conduct a pressure fall-off test. For example, a drilling break may be encountered wherein the rate of drill bit penetration significantly changes.

Also, a logging while drilling tool included in the drilling string 18 may provide an indication that a zone of interest has been intersected. Also, the operator may be observing the drilling cuttings circulated with the drilling fluid and may observe an indication that petroleum-bearing strata have been intersected.

In any of these events, a pressure fall-off test can then be conducted in the manner described above by setting the packer and closing the tester valve and the monitoring the pressure within the well bore as it falls off.

Figure 3:
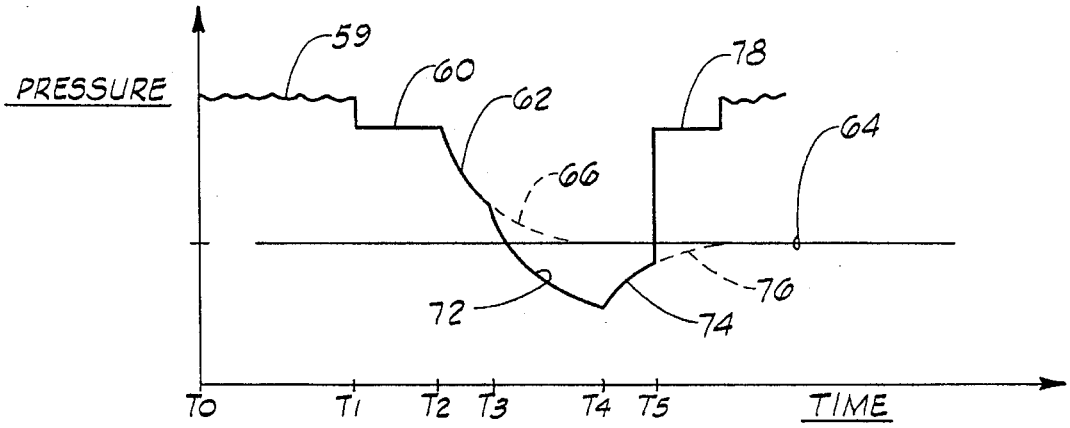
FIG. 3 is a pressure-versus-time plot showing a pressure fall-off test followed by an artificial pump-down of the formation pressure followed by a pressure build-up test.
Figure 4:
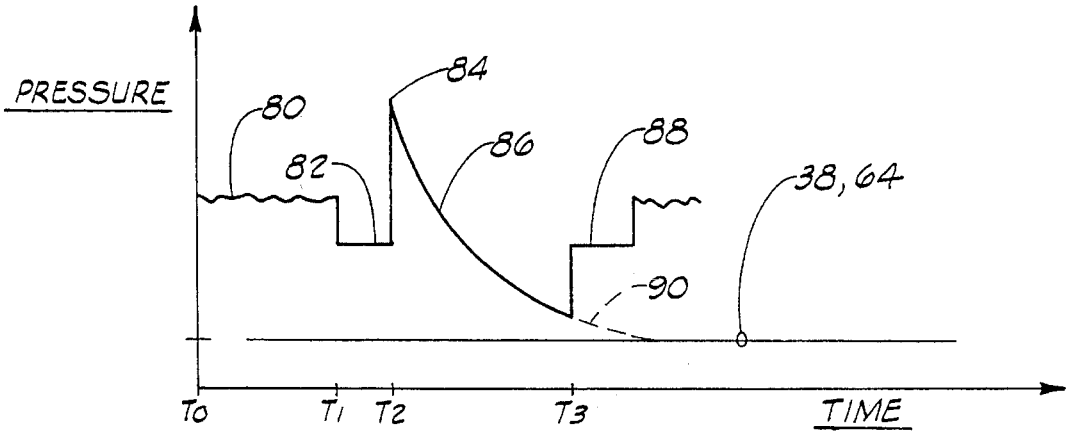
FIG. 4 is a pressure-versus-time plot which illustrates an injection fall-off test.

FIGS. 3 and 4 illustrate variations of the pressure fall-off testing methods of the present invention. FIG. 3 corresponds to the apparatus schematically illustrated in FIG. 1E.

In the interval from $T_0$ to $T_1$ drilling has been conducted and the pressure monitored by monitoring means 26 is represented by the erratic pumping pressure line 59. When the well reaches the depth illustrated in FIG. 1C and pumping stops, the pressure drops to hydrostatic pressure 60.

Then the packer 24 may be set and the tester valve 22 closed as illustrated in FIG. 1D to generate the partial pressure fall-off curve 62. A natural formation pressure 64 of the subsurface formation 58 may be approximated by extrapolating the data from curve 62 along dashed line 66 as previously described.

Additional data can be obtained by pumping down the pressure within the well bore adjacent the second subsurface formation 58. This can be accomplished by running a wireline pump 66 on a wireline 68 down into engagement with a seat 70 located above tester valve 22 as schematically illustrated in FIG. 1E. The electrically operated pump 66 is then used to pump fluids from the well bore 12 below packing element 30 to further reduce the pressure in the well bore 12 adjacent second subsurface formation 58 along the pressure pump-down curve 72 shown in FIG. 3. The pump draw-down curve 72 itself is not made up of significant data since it depends upon the characteristics of the pump. As shown in FIG. 3, the pressure in the borehole 12 adjacent second subsurface formation 58 is pumped down to a pressure less than the natural formation pressure 64. This occurs from time interval $T_3$ to $T_4$. Then the pumping with pump 66 is stopped and pressure in the borehole 12 adjacent subsurface formation 58 is allowed to build up toward the natural formation pressure 64 along build-up curve 74. The build-up occurs from time $T_4$ to $T_5$ and typically will be discontinued prior to reaching the natural formation pressure 64. Enough pressure build-up data on curve 64 is obtained to be able to extrapolate along the dashed curve 76 to estimate the natural formation pressure 64. At time $T_5$ the pump 66 is removed and the subsurface formation 58 is again exposed to hydrostatic pressure thus returning to hydrostatic pressure level 78.

With the technique illustrated in FIG. 3 it is noted that two means are provided for estimating the natural formation pressure 64, namely the extrapolation 66 of fall-off curve 62, and the extrapolation 76 of build-up curve 74 which may be compared to provide a more accurate estimate of the natural formation pressure 64.

With both fall-off and pressure build-up data as described above, sufficient information may be obtained to allow calculation of permeability and skin factors for the subsurface formation in question.

As an alternative the wireline conveyed downhole pumps, a jet type hydraulic pump (not shown) may be installed in the test string. The jet pump is operated by pumping fluid down through the well annulus to power the jet pump which then pumps fluids up through the testing string. Such pumps are available for example from Trico Industries, Inc.

FIG. 4 illustrates another modification of the methods of the present invention.

In FIG. 4, drilling is occurring initially as represented by the erratic drilling pressure level 80. When drilling stops the pressure drops to hydrostatic level 82 from time interval $T_1$ to $T_2$. At time $T_2$ additional pressure is placed upon the subsurface formation 16 (See FIGS. 1A and 1B) through the open tester valve 22 by applying pressure from pressure source 81 through supply line 83 to test string 18 to raise the pressure adjacent subsurface formation 16 at time $T_2$ to a level 84 greater than hydrostatic pressure 82. Pressure may also be applied to annulus 32 from source 85 through supply line 87. The packer 24 is then set and the tester valve 22 is closed to trap the increased pressure level 84 and an extended pressure fall-off curve 86 is generated from time $T_2$ to time $T_3$. The curve 86 may be referred to as an injection fall-off test curve 86. At time $T_3$ the tester valve 22 is again opened and pressure returns to a hydrostatic pressure level 88. Such an injection fall-off curve 86 provides additional data which may be used to extrapolate along line 90 to estimate the natural formation pressure 38 or 64 of whichever formation 16 or 58 is being tested.

As previously noted, with any of the tests described above, it may be desirable from time to time to trap a well fluid sample and return it to the surface for examination. A means for trapping such a well fluid sample is schematically illustrated in FIGS. 5A–5B.

Figure 5B:
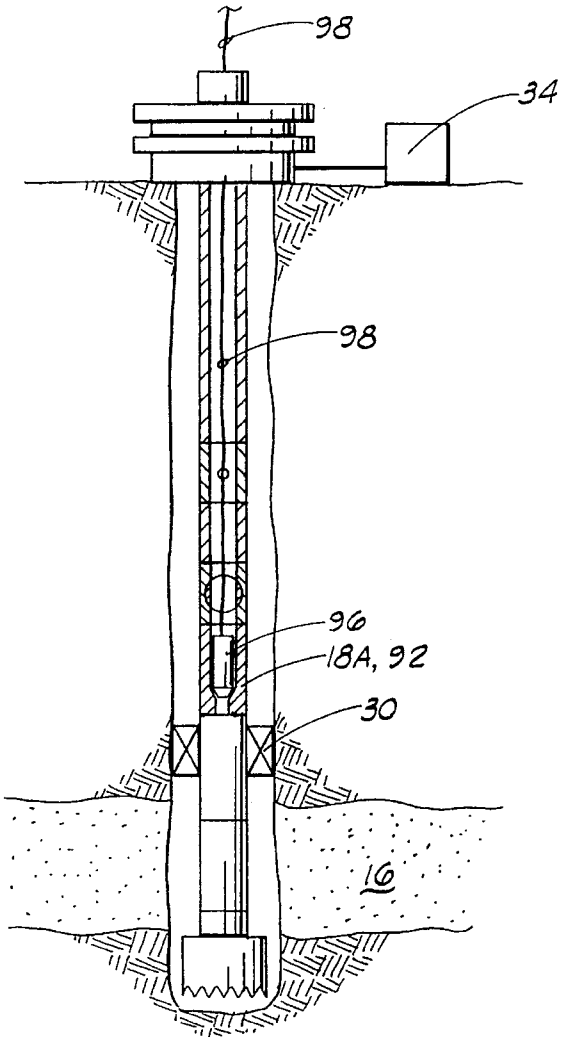
FIGS. 5A–5B comprise a sequential series of illustrations similar to FIGS. 1A–1B showing an alternative embodiment of the invention wherein a surge chamber is run into the test string to trap and retrieve a sample of well fluid.
Figure 5A:
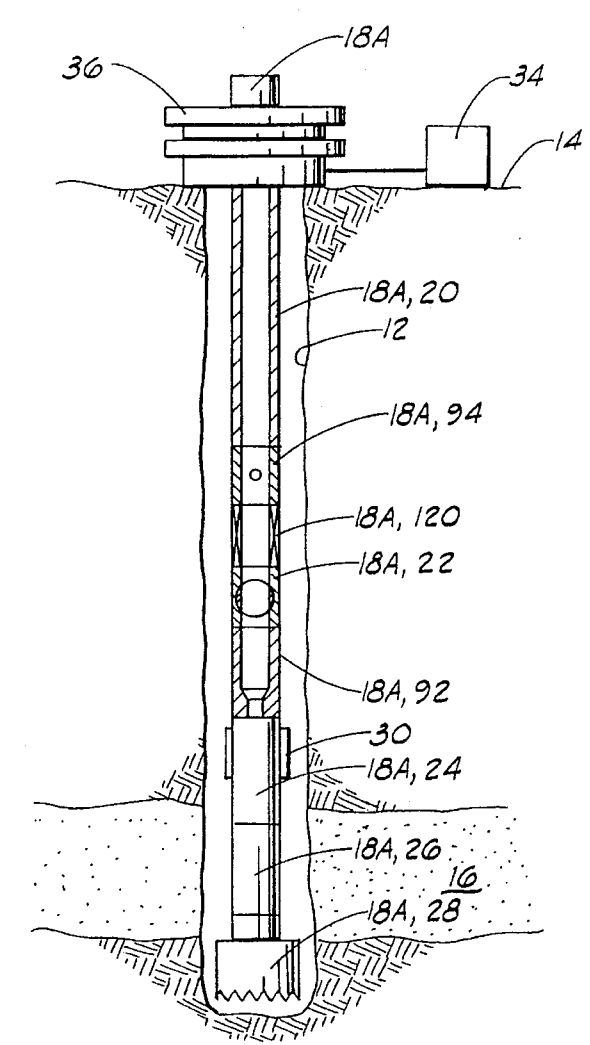

FIG. 5A is similar to FIG. 1A and illustrates a modified testing string 18A. The modified testing string 18A is similar to the testing string 18 of FIG. 1A, and identical parts carry identical numerals. The testing string 18A includes two additional components, namely a surge chamber receptacle 92 located between the tester valve 22 and packer 24, and a circulating valve 94 located above the tester valve 22.

After the packing element 30 has been set as shown in FIG. 5B, a sample of well fluid may be taken from the subsurface formation 16 by running a surge chamber 96 on wireline 98 into engagement with the surge chamber receptacle 92. The surge chamber 96 is initially empty or contains atmospheric pressure, and when it is engaged with the surge chamber receptacle 92, a passageway communicating the surge chamber 96 with the subsurface formation 16 is opened so that well fluids may flow into the surge chamber 96. The surge chamber 96 is then retrieved with wireline 98. The surge chamber 96 and associated valving may for example be constructed in a manner similar to that shown in U.S. Pat. No. 3,111,169 to Hyde, the details of which are incorporated herein by reference.

Also, the surge chamber 96 itself could serve as a closure means for closing the bore of the tester valve. To do this, it would be necessary to build a time delay into the operative connection between the surge chamber and the subsurface formation so that after the surge chamber is received in the surge receptacle, a sufficient time interval would be permitted for pressure to fall off in the well bore below the packer. After the fall-off test has been conducted, the subsurface formation would then be communicated with the receptacle to allow a sample to surge into the surge chamber. Repeated pressure fall-off tests followed by sampling tests could be accomplished by removing the surge chamber, evacuating it and then running it back into the well.

The testing string 18A shown in FIGS. 5A and 5B may also include an electronic control sub 120 for receiving remote command signals from surface control station 34.

Figure 6:
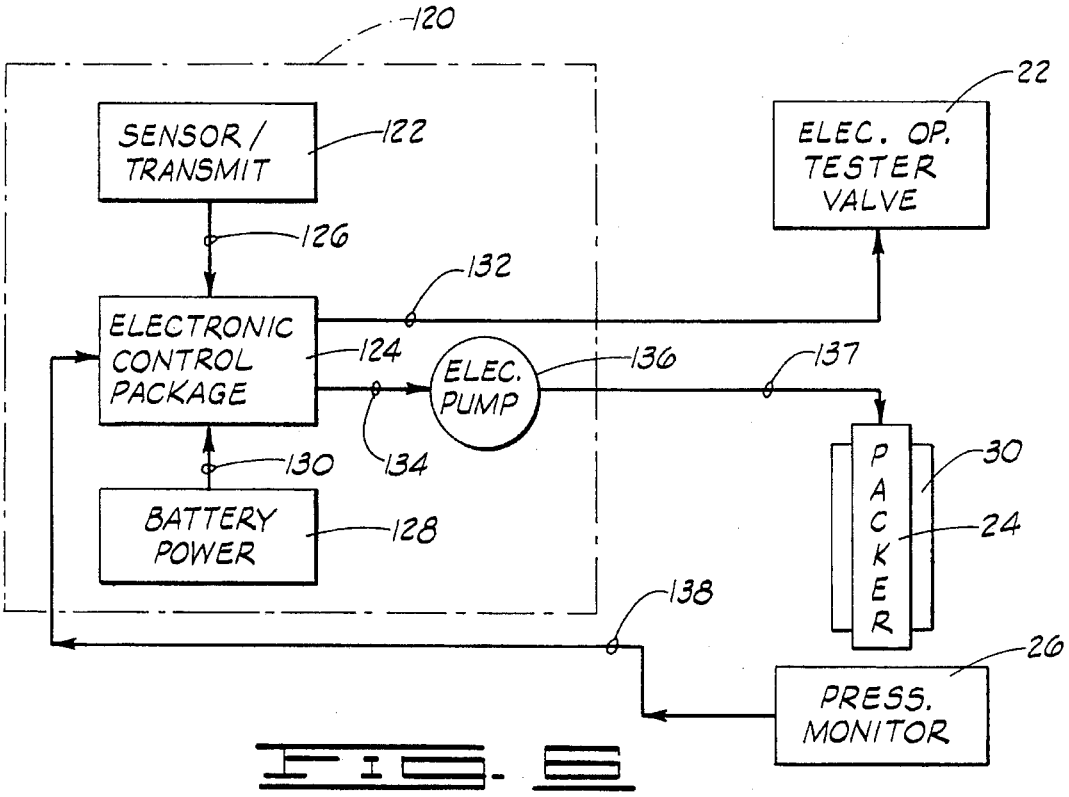
FIG. 6 is a schematic illustration of a remote control system for controlling a packer and closure tool from a surface control station.

The electronic control sub 120 is schematically illustrated in FIG. 6. Control sub 120 includes a sensor/transmitter 122 which can receive communication signals from surface control system 34 and which can transmit signals and data back to surface control system 34. The sensor/transmitter 122 is communicated with an electronic control package 124 through appropriate interfaces 126. The electronic control package 124 may for example be a microprocessor based controller. A battery power pack 128 provides power over power line 130 to the control package 124.

The microprocessor based control package 124 generates appropriate drive signals in response to the command signals received by sensor 122 and transmits those drive signals over electrical lines 132 and 134 to an electrically operated tester valve 22 and an electric pump 136, respectively.

The electrically operated tester valve 22 may be the tester valve 22 schematically illustrated in FIGS. 5A and 5B.

The electrically powered pump 136 takes well fluid from either the annulus 32 or the bore of tubing string 20 and directs it through hydraulic line 137 to the inflatable packer 24 to inflate the inflatable element 30 thereof.

Thus the electronically controlled system shown in FIG. 6 can control the operation of tester valve 22 and inflatable packer 24 in response to command signals received from the surface control station 34.

Also, the pressure monitor 26 may be connected with electronic control package 126 over electrical conduit 138, and the microprocessor based control package 124 can transmit data generated by pressure monitor 26 back up to the surface control station 34 while the drill string 18A remains in the well bore 12.

The sensor/transmitter 122 may also be generally described as a communication means 122 operably associated with the pressure monitoring means 26 for transmitting pressure fall-off data to the surface control station 34 while the test string 18 remains in the uncased borehole 12.

Figure 7:
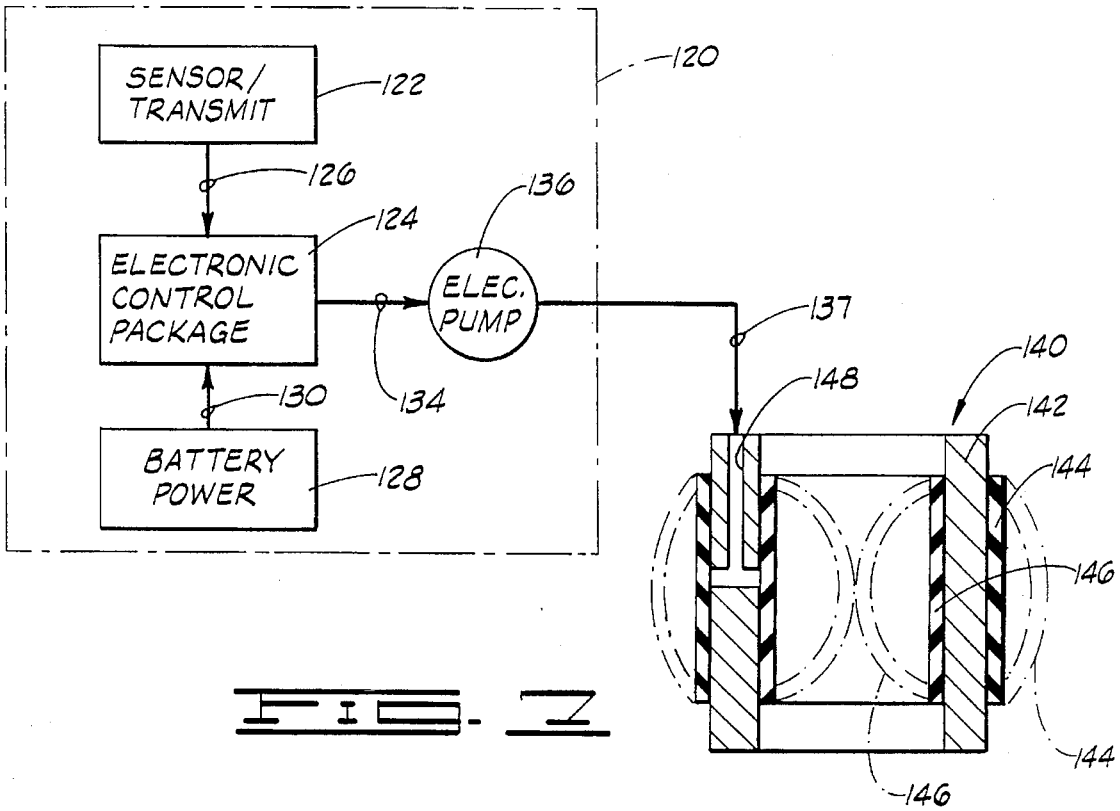
FIG. 7 is a schematic illustration similar to FIG. 6 which also schematically illustrates a combination inflatable packer and closure valve.
Figures 5A, 5B, 5C:
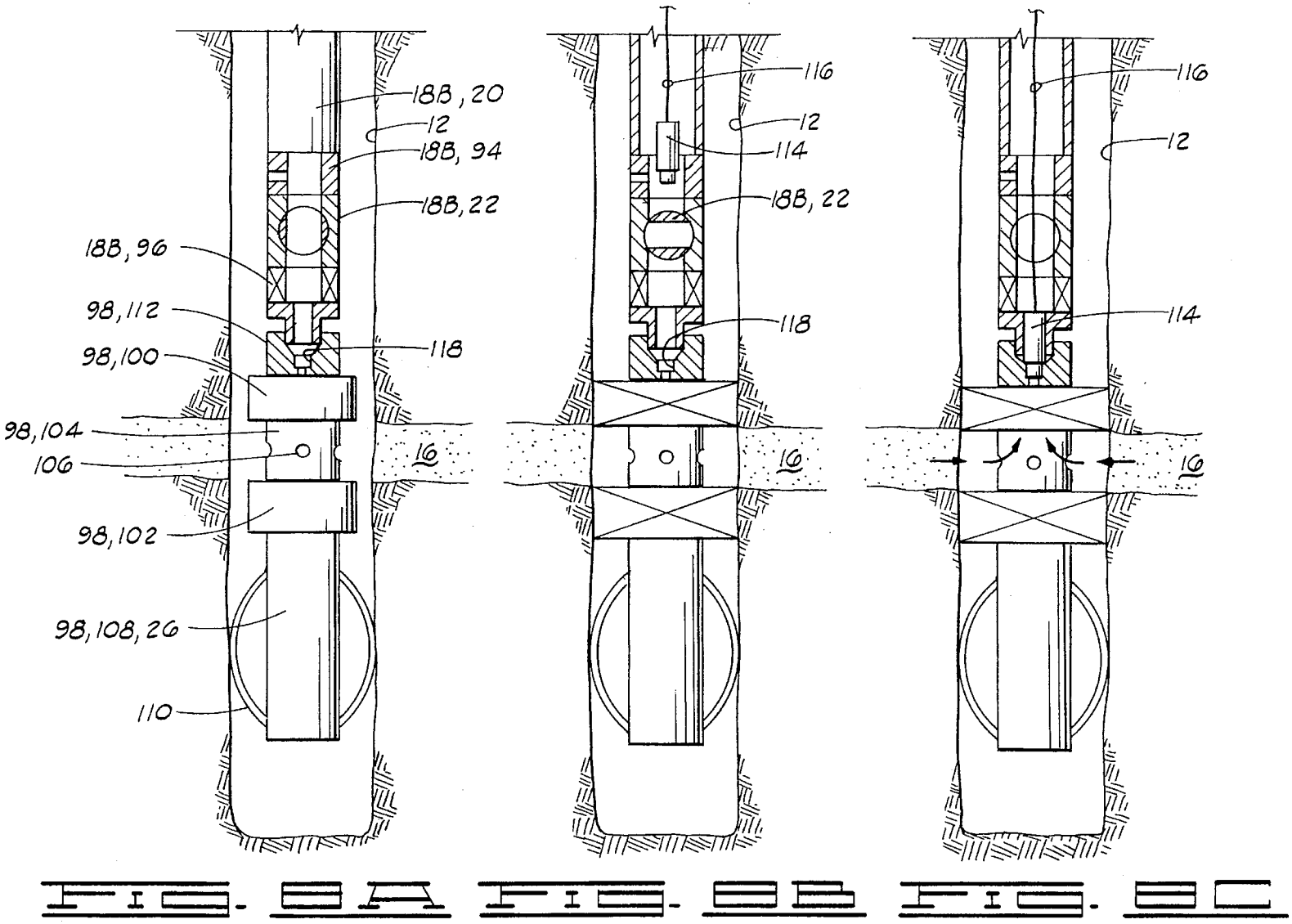

FIG. 7 illustrates an electronic control sub 120 like that of FIG. 6 in association with a modified combination packer and closure valves means 140.

The combination packer/closure valve 140 at FIG. 7 includes a housing 142 having an external inflatable packer element 144 and an internal inflatable closure element 146. An inflation passage 148 defined in housing 142 communicates with both the external inflatable packer element 144 and the internal inflatable closure valve element 146. When fluid under pressure is directed through hydraulic conduit 137 to the passage 148, it inflates both the internal and external elements to the phantom line positions shown in FIG. 7 so that the external element 144 seals off the well annulus 32 while the internal element 146 simultaneously closes off the bore of testing string 18.

The electric pump 136 may be described as an actuating means for closing the tubing string closure means such as tester valve 22 or internal inflatable element 146 and for inflating the inflatable packer such as 144 or 30 in response to remote command signals received by sensor 122.

Also, the combination inflatable packer and closure valve 140 could be inflated with a pump powered by rotation of the drill string like that used in the Halliburton Hydroflate system. Such a rotationally operated pump is disclosed for example in U.S. Pat. Nos. 4,246,964 and 4,313,495 to Brandell and assigned to the assignee of the present invention.

Techniques For Remote Control

Many different systems can be utilized to send command signals from the surface location 34 down to the sensor 122 to control the various operating elements of the testing string 18.

One suitable system is the signalling of the control package 124 and receipt of feedback from the control package 124 using acoustical communication which may include variations of signal frequencies, specific frequencies, or codes of acoustic signals or combinations of these. The acoustical transmission media includes tubing string, casing string, electric line, slick line, subterranean soil around the well, tubing fluid, and annulus fluid. An example of a system for sending acoustical signals down the tubing string is seen in U.S. Pat. Nos. 4,375,239; 4,347,900; and 4,378,850 all to Barrington and assigned to the assignee of the present invention.

A second suitable remote control system is the use of a mechanical or electronic pressure activated control package which responds to pressure amplitudes, frequencies, codes or combinations of these which may be transmitted through tubing fluid, casing fluid, fluid inside coiled tubing which may be transmitted inside or outside the tubing string, and annulus fluid. The system can also respond to a sensed downhole pressure.

A third remote control system which may be utilized is radio transmission from the surface location 34 or from a subsurface location, with corresponding radio feedback from the downhole tools to the surface location or subsurface location. The subsurface location may be a transmitter/receiver lowered into the well on a wireline.

A fourth possible remote control system is the use of microwave transmission and reception.

A fifth type of remote control system is the use of electronic communication through an electric line cable suspended from the surface to the downhole control package. Such a system may be similar to the Halliburton RT-91 system which is described in U.S. Pat. No. 5,236,048 to Skinner et al.

A sixth suitable remote control system is the use of fiberoptic communications through a fiberoptic cable suspended from the surface to the downhole control package.

A seventh possible remote control system is the use of acoustic signalling from a wireline suspended transmitter to the downhole control package with subsequent feedback from the control package to the wireline suspended transmitter/receiver. Communication may consist of frequencies, amplitudes, codes or variations or combinations of these parameters.

An eighth suitable remote communication system is the use of pulsed X-ray or pulsed neutron communication systems.

As a ninth alternative, communication can also be accomplished with the transformer coupled technique which involves wire conveyance of a partial transformer to a downhole tool. Either the primary or secondary of the transformer is conveyed on a wireline with the other half of the transformer residing within the downhole tool. When the two portions of the transformer are mated, data can be interchanged.

All of the systems described above may utilize an electronic control package 124 that is microprocessor based.

It is also possible to utilize a preprogrammed microprocessor based control package 124 which is completely self-contained and which is programmed at the surface to provide a pattern of operation of the tools contained in test string 18. For example, a remote signal from the surface could instruct the microprocessor based control package 124 to start one or more program sequences of operations. Also, the preprogrammed sequence could be started in response to a sensed downhole parameter such as bottom hole pressure. Such a self-contained system may be constructed in a manner analogous to the self-contained downhole gauge system shown in U.S. Pat. No. 4,866,607 to Anderson et al., and assigned to the assignee of the present invention.

FIGS. 8A–8C schematically illustrate the use of a testing string which does not include a drill bit. The modified testing string is denoted by the numeral 18B. The testing string 18B includes the tubing string 20 and ball type tester valve 22 as previously described. It also includes a circulating valve 94 located above the tester valve 22. A position correlation device 96 is included to aid in positioning of the test string 18B relative to the subsurface formation 16.

When using the testing string 18B of FIG. 6A, the well bore 12 will previously have been drilled. The drill string is removed, and a well log is run with a conventional logging tool. As will be understood by those skilled in the art, the well log obtained with the conventional logging tool will identify the various subsurface strata including formation 16 which are intersected by the bore hole 12.

The position correlation device 96 may in fact be a well logging tool which can recognize the various strata previously identified by the conventional well log. The correlation device 96 will communicate with a surface control station over wireline, or through other means such as mud pulse telemetry, so that the test string 18B can be accurately located with its packer 98 adjacent the subsurface formation 16 of interest.

The correlation device 96 may also be a correlation sub having a radioactive tag therein which can be used to determine accurately the position of the tubing string 18B through the use of a conventional wireline run correlation tool which can locate the radioactive tag in correlation sub 94.

The packer 98 illustrated in FIG. 8A is a straddle packer including upper and lower packer elements 100 and 102 separated by a packer body 104 having ports 106 therein for communicating the bore of tubing string 20 with the well bore 12 between packer elements 100 and 102.

The packer 98 includes a lower housing 108 which includes the pressure monitoring means 26 previously described. The housing 108 has belly springs 110 extending radially therefrom and engaging the borehole 12 to aid in setting of the straddle packer 98. The straddle packer 98 includes an inflation valve assembly 112 which controls flow of fluid from the interior of tubing string 20 to the inflatable elements 100 and 102 through an inflation passage (not shown).

After the borehole 12 has been drilled and an open hole log has been run so as to identify the various zones of interest such as subsurface formation 16, the test string 18B is run into the well and located at the desired depth as determined by the previously run open hole log through the use of the correlation tool 96. The test string 18B is run into the uncased borehole 12 as shown in FIG. 8A until the straddle packer elements 100 and 102 are located above and below the subsurface formation 16 which is of interest.

Then the inflatable elements 100 and 102 are inflated to set them within the uncased borehole 12 as shown in FIG. 8B. The inflation and deflation of the elements 100 and 102 are controlled by physical manipulation of the tubing string 20 from the surface.

The details of construction of the straddle packer 98 may be found in our co-pending application entitled *Early Evaluation System*, designated as attorney docket number HRS 91.225A1, filed concurrently herewith, the details of which are incorporated herein by reference.

After the straddle packer 98 has been set as illustrated in FIG. 8B, or at approximately the same time as the straddle packer 98 is set, the ball type tester valve 22 is moved to a closed position as shown in FIG. 8B. This may be accomplished in response to physical manipulation of the tubing string 20, or in response to a remote control system, depending upon the design of the closure valve 22.

Once the straddle packer 98 is set and the tester valve 22 is closed as shown in FIG. 8B, pressure fall-off tests may be conducted in a manner similar to that previously described with regard to FIG. 2. The pressure data is monitored and stored by the monitoring means 26 contained in lower housing 108.

The straddle packer assembly 98 includes a surge chamber receptacle 118 therein, the details of which may also be found in our above-referenced co-pending application entitled *Early Evaluation System.*

When it is desired to take a well fluid sample, the tester valve 22 is opened and a surge receptacle 114 is run on wireline 116 into engagement with the surge chamber receptacle 118 as shown in FIG. 1C. When the surge chamber 114 is engaged with surge chamber receptacle 118, a valve associated therewith is opened thus allowing a well fluid sample to flow into the surge chamber 114. The surge chamber 114 can then be retrieved to retrieve the well fluid sample to the surface.

The use of a straddle packer such as shown in FIGS. 8A–8C is particularly desirable when utilizing a surge chamber like surge chamber 114 due to the fact that the straddle packer is pressure balanced and can better withstand the large differential pressure loads which may be generated during surge testing.

Also, instead of a wireline conveyed surge chamber 114, a well sample can be taken by running a coiled tubing string into the well and stinging it into the surge receptacle 118 in a manner like that disclosed in the above-mentioned co-pending application entitled *Early Evaluation Systems*, the details of which are incorporated herein by reference.

Multiple pressure fall-off tests can be conducted with the test string 18B by opening and closing the tester valve 22, to generate data like that described above with regard to FIG. 2.

Also, the well can be pumped down to generate data like that described above with regard to FIG. 3.

Also, an injection fall-off test may be conducted like that described above with regard to FIG. 4.

While the methods of fall-off testing of the present invention have been disclosed in the context of open hole testing, these tests could also be useful in testing cased wells; even testing of wells which have been on production for some time. One situation where pressure fall-off testing of cased wells may become particularly desirable in the future is in situations where for environmental reasons it is undesirable to conduct a conventional flow test due to the unavailability of a place for disposal of the produced fluids. The tests of the present invention can evaluate a formation without producing fluid from the formation.

Thus it is seen that the apparatus and methods of the present invention readily achieve the ends and advantages mentioned as well as those inherent therein. While certain preferred embodiments of the invention have been described and illustrated for purposes of the present disclosure, numerous changes may be made by those skilled in the art which changes are encompassed within the scope and spirit of the present invention as defined by the appended claims.

What is claimed is:

1. A method of testing a zone of interest in subsurface formation intersected by a well, comprising:

(a) providing a column of fluid in said well, said column of fluid having an overbalanced hydrostatic pressure at said subsurface formation greater than a formation pressure of said subsurface formation;

(b) running a testing string into said well, said testing string including a packer, a pressure monitor and a closure tool arranged to close a bore of said testing string;

(c) shutting in said subsurface formation by setting said packer and closing said bore of said testing string with said closure tool and thereby initially trapping said overbalanced hydrostatic pressure of said column of fluid in said well below said packer; and (d) after step (c), monitoring a pressure fall-off in said well below said packer.

2. The method of claim 1, further comprising:

using pressure fall-off data obtained in step (d) to estimate said zone pressure.

3. The method of claim 1, wherein:

in step (b) said testing string is a drill string including a drill bit on a lower end thereof.

4. The method of claim 3, further comprising:

after step (d), unsetting said packer, opening said bore of said drill string, and rotating said drill bit to extend said well;

then repeating steps (c) and (d) to test a lower zone of interest in a subsurface formation; and comparing pressure fall-off data for said first-mentioned subsurface zone and for said lower subsurface zone to determine whether said first-mentioned subsurface zone and said lower subsurface zone are parts of a common geological formation.

5. An early evaluation method of open-hole testing while drilling, comprising:

(a) drilling a borehole into a first subsurface formation with a drill string including a drill bit, a drill string closure valve, a packer and a pressure recording apparatus;

(b) providing a column of drilling fluid in said borehole having a hydrostatic pressure at said first subsurface formation greater than a natural formation pressure of said first subsurface formation;

(c) interrupting drilling of said borehole without removing said drill string from said borehole;

(d) while said drilling is interrupted, shutting in said first subsurface formation by setting said packer and closing said closure valve;

(e) after step (d), monitoring pressure fall-off data in said borehole below said packer for a sufficient time and with sufficient precision to extrapolate said data to said natural formation pressure, said time being less than a time required for pressure in said borehole to actually fall off to said natural formation pressure; and (f) extrapolating said data and thereby estimating said natural formation pressure.

6. The method of claim 5, further comprising:

after step (e), unsetting said packer, opening said closure valve, and continuing drilling of said borehole into a second subsurface formation; and repeating steps (c), (d), (e) and (f) with respect to said second subsurface formation to test said second subsurface formation.

7. The method of claim 6, further comprising:

comparing the pressure fall-off data for said first and second subsurface formations to determine whether said first and second subsurface formations are part of a common geological formation.

8. The method of claim 5, further comprising:

(g) while said drilling is interrupted, running a sampling tool into said drill string;

(h) engaging said sampling tool with said drill string; and (i) flowing a well fluid sample from said first subsurface formation into said sampling tool.

9. The method of claim 8, further comprising:

after step (i), unsetting said packer, opening said closure valve, and continuing drilling of said borehole into a second subsurface formation;

repeating steps (c), (d), (e) and (f) with respect to said second subsurface formation to test said second subsurface formation;

comparing the pressure fall-off data for said first and second subsurface formations to determine whether said first and second subsurface formations are part of a common geological formation; and if said comparing step indicates that said first and second subsurface formations are not part of a common geological formation, repeating steps (g), (h) and (i) to take a well fluid sample from said second subsurface formation.

10. The method of claim 5, wherein:

step (b) includes increasing pressure of said column of drilling fluid above hydrostatic pressure to inject drilling fluid into said first subsurface formation; and step (e) includes monitoring injection fall-off data.

11. The method of claim 5, further comprising:

after step (e), opening said closure valve to again expose said first subsurface formation to said hydrostatic pressure, the reclosing said closure valve and repeating said step (e).

12. The method of claim 5, further comprising:

(g) providing a downhole pump in said drill string;

(h) pumping said borehole adjacent said first subsurface formation down to a pressure less than said natural formation pressure; and (i) stopping said pumping and monitoring pressure buildup data in said borehole below said packer.

13. The method of claim 5, further comprising:

transmitting said pressure fall-off data up to a surface location while said drill string remains in said borehole.

14. An early evaluation testing string for evaluating a natural formation pressure of a subsurface formation intersecting an uncased borehole, comprising:

a tubing string having a tubing bore; packer means, carried by said tubing string, for sealing a well annulus between said tubing string and said uncased borehole above said subsurface formation;

tubing string closure means for selectively closing said tubing bore and thereby shutting in said subsurface formation and opening said tubing bore such that said tubing bore is in communication with said well annulus; and pressure monitoring means, located below said tubing string closure means, for monitoring pressure fall-off data in said uncased borehole below said packer means with sufficient precision to allow extrapolation of said data to estimate said natural formation pressure.

15. The early evaluation testing string of claim 14, wherein:

said packer means and said tubing string closure means are operably associated so that said tubing string closure means automatically closes when said packer means is set to seal said uncased borehole.

16. The early evaluation testing string of claim 15, wherein:

said packer means includes an inflatable packer including a radially inwardly extendable inflatable portion which closes said tubing bore to provide said tubing string closure means.

17. The early evaluation testing string of claim 15, wherein said packer means is a weight-operated packer.

18. An early evaluation testing string for evaluating a natural formation pressure of a subsurface formation intersected by an uncased borehole, comprising:

a tubing string having a tubing bore;

packer means, carried by said tubing string, for sealing a well annulus between said tubing string and said uncased borehole above said subsurface formation;

tubing string closure means for closing said tubing bore and thereby shutting in said subsurface formation, said tubing string closure means including a ball-type tester valve; and pressure monitoring means, located below said tubing string closure means, for monitoring pressure fall-off data in said uncased borehole below said packer means with sufficient precision to allow extrapolation of said data to estimate said natural formation pressure.

19. An early evaluation testing string for evaluating a natural formation pressure of a subsurface formation intersected by an uncased borehole, comprising:

a tubing string having a tubing bore;

packer means, carried by said tubing string, for sealing a well annulus between said tubing string and said uncased borehole above said subsurface formation, said packer means being an inflatable packer;

tubing string closure means for closing said tubing bore and thereby shutting in said subsurface formation;

pressure monitoring means, located below said tubing string closure means, for monitoring pressure fall-off data in said uncased borehole below said packer means with sufficient precision to allow extrapolation of said data to estimate said natural formation pressure;

a remote control system responsive to a remote command signal transmitted from a surface control station; and actuating means, operably associated with said remote control system, for closing said tubing string closure means and inflating said inflatable packer in response to said remote command signal.

20. An early evaluation testing string for evaluating a natural formation pressure of a subsurface formation intersected by an uncased borehole, comprising:

a tubing string having a tubing bore;

packer means, carried by said tubing string, for sealing a well annulus between said tubing string and said uncased borehole above said subsurface formation;

tubing string closure means for closing said tubing bore and thereby shutting in said subsurface formation;

pressure monitoring means, located below said tubing string closure means, for monitoring pressure fall-off data in said uncased borehole below said packer means with sufficient precision to allow extrapolation of said data to estimate said natural formation pressure; and communication means, operably associated with said pressure monitoring means, for transmitting pressure fall-off data to a surface control station while said testing string remains in said uncased borehole.

21. An early evaluation testing string for evaluating a natural formation pressure of a subsurface formation intersected by an uncased borehole, comprising:

a tubing string having a tubing bore;

packer means, carried by said tubing string, for sealing a well annulus between said tubing string and said uncased borehole above said subsurface formation;

tubing string closure means for closing said tubing bore and thereby shutting in said subsurface formation;

pressure monitoring means, located below said tubing string closure means, for monitoring pressure fall-off data in said uncased borehole below said packer means with sufficient precision to allow extrapolation of said data to estimate said natural formation pressure; and a downhole formation pump means for reducing fluid pressure in said uncased borehole adjacent said formation to a pressure below said natural formation pressure so that said pressure monitoring means can monitor a pressure buildup.

22. An early evaluation testing string for evaluating a natural formation pressure of a subsurface formation intersected by an uncased borehole, comprising:

a tubing string having a tubing bore;

packer means, carried by said tubing string, for sealing a well annulus between said tubing string and said uncased borehole above said subsurface formation;

tubing string closure means for closing said tubing bore and thereby shutting in said subsurface formation;

pressure monitoring means, located below said tubing string closure means, for monitoring pressure fall-off data in said uncased borehole below said packer means with sufficient precision to allow extrapolation of said data to estimate said natural formation pressure; and position correlation means carried by said tubing string for correlating a position of said packer means relative to said subsurface formation.

* * * * *